US006409402B2

(12) United States Patent
Tani et al.

(10) Patent No.: US 6,409,402 B2
(45) Date of Patent: Jun. 25, 2002

(54) COSMETIC PENCIL

(75) Inventors: Yoshikazu Tani; Arata Sasaki, both of Tokyo (JP)

(73) Assignee: Tokiwa Corporation, Gifu (JP)

( * ) Notice: Subject to any disclaimer, the term of this patent is extended or adjusted under 35 U.S.C. 154(b) by 0 days.

(21) Appl. No.: 09/782,155

(22) Filed: Feb. 14, 2001

(30) Foreign Application Priority Data

Feb. 14, 2000 (JP) ..... 2000-035739

(51) Int. Cl.[7] ..... B43K 19/02; B43K 19/06; B43K 19/14

(52) U.S. Cl. ..... 401/96; 401/88

(58) Field of Search ..... 401/50, 88, 91–93, 401/96, 98, 192

(56) References Cited

U.S. PATENT DOCUMENTS 1,166,436 A * 1/1916 Colgate ..... 401/88
3,704,071 A * 11/1972 Muller et al. ..... 401/96
4,413,921 A * 11/1983 Fotiu et al. ..... 401/96
5,281,039 A * 1/1994 Hsiung et al. ..... 401/195
5,340,226 A * 8/1994 Griebel et al. ..... 401/96
5,352,051 A * 10/1994 Tamura et al. ..... 401/48
5,360,281 A * 11/1994 Kamen et al. ..... 401/96
5,749,664 A * 5/1998 Inoue et al. ..... 401/88
5,957,607 A * 9/1999 Tsai ..... 401/192
5,984,556 A * 11/1999 Gray et al. ..... 401/192

FOREIGN PATENT DOCUMENTS

GB 883917 * 12/1961 ..... 401/192

* cited by examiner

*Primary Examiner*—Gregory Huson
*Assistant Examiner*—Tuan Nguyen
(74) *Attorney, Agent, or Firm*—Arent Fox Kintner Plotkin & Kahn

(57) ABSTRACT

A cosmetic pencil is provided in which the color tone of its cosmetic material may be distinguished from the outside without marking a cylindrical shaft or a tail cap thereof with the same color, and does not require a secondary processing such as cutting processing for preventing a movement of the cosmetic material when the cylindrical shaft is formed. A transparent cylindrical shaft (2) having a good cutting property is formed from a composite material of olefin-based polymer with polypropylene as the base material, a softened cosmetic material (M) is filled and set in a shaft hole (22) of this cylindrical shaft (2), and the tip end side of the cylindrical shaft (2) is cut to use the cosmetic material (M). The transparent cylindrical shaft (2) has moving prevention measure (5) for the cosmetic material (M) to prevent the filled cosmetic material (M) from moving within the shaft hole (22), and this moving prevention measure (5) may be molded by an injection molding method.

6 Claims, 5 Drawing Sheets

COSMETIC PENCIL

BACKGROUND OF THE INVENTION

1. Field of the Invention

The present invention relates to a cosmetic pencil structure which is filled with stick shaped cosmetics such as lip color pencil, eye shadow pencil, cheek color pencil and eyebrow pencil, for example in a cylindrical shaft.

2. Description of the Related Art

As a conventional cosmetic pencil, cosmetics with a shaft body (cylindrical shaft) that is cylindrical in shape filled with a cosmetic material or a pigment replacing the lead of a pencil (for example, lip color pencil, eyebrow pencil, eye shadow pencil and the like) are known.

The cosmetic pencil is usually provided with a cylindrical shaft for storing the cosmetic material, a tail cap to be fitted at the rear end side of the cylindrical shaft, and a cap member for covering the tip end side of the cylindrical shaft.

Further, to store the cosmetic material inside the cosmetic pencil, for example, a method of filling the melted cosmetic material from the rear end side of the cylindrical shaft (back filling method), and then cooling and setting it, is used. Then, the cosmetic material set in the cylindrical shaft is fixed only by contact (friction) with the inner surface of the cylindrical shaft.

The cylindrical shaft is required to have a cutting characteristic so that cutting is easily carried out with a sharpener or the like, a molding characteristic for easily shaping a cylindrical shape, and an anti-chemical characteristic so it is not damaged by the cosmetic components that are stored therein. Conventionally, as the material for the cylindrical shaft, wood, synthetic wood, plastic (resin) material such as polyethylene (PE) or the like has been used. In the case wood is used, it is manufactured from a wood panel by shape-out processing. Further, in the case of synthetic wood, resin material such as or polyethylene (PE), and the like, a cylindrical shaft is molded by an extrusion method, and thereafter a pointing processing (beveling the outer surface shape of the tip end), and a hollowing processing for tail cap fitting, and the like are carried out.

Further, the cosmetic pencil is often arranged in a showcase in various colors so that it is easy for consumers to select the favored color. However, in cosmetic pencils formed with the conventional materials including those made of polyethelene (PE) resin, the color of the cosmetic material inside cannot be determined since the cylindrical shaft is not transparent. Therefore, approximately the same color is marked on the peripheral surface or the tail cap of the cylindrical shaft to display the color of the cosmetic material.

However, in the case of marking the same color of the stored cosmetic material to the peripheral surface or the tail cap of the cylindrical shaft, there are the following shortcomings:

(1) since the characteristics of the components of the paint differed to the main components of the cosmetic material, it is difficult to show the color and feel of the actual cosmetic material by paint.

(2) if the cosmetic material differs then the paint differs, so that it is necessary to wash the paint hopper (case) and the like each time, which caused the painting process to be laborious and time-consuming, and therefore is not suitable in the case where various kinds of products are manufactured in small quantities. In this case, by making the cylindrical shaft transparent, the color shade of the cosmetic material inside may be visualized.

However, a conventional transparent resin with polyvinyl chloride (PVC), or the like, as the base material has extremely poor cutting characteristics, so that it is not at all suitable as the material for the cylindrical shaft of the cosmetic pencil.

Further, the conventional cosmetic pencil is fixed only by the contact (friction) of the stored cosmetic material with the inner surface of the cylindrical shaft, but the cosmetic material has a smooth surface characteristic so the cosmetic material may be applied onto the skin smoothly. Also if the inner surface of the material of the cylindrical shaft is flat it becomes slippery. Therefore, there is fear that, when the cosmetic material is pressed during use, or if the cosmetic pencil is given shock such as by being dropped, the cosmetic material would move in the shaft direction or rotate within the cylindrical shaft.

With the conventional cosmetic pencil, a step processing (refer to FIG. 8B) is carried out to the inner wall of the cylindrical shaft obtained by extrusion to prevent movement of the cosmetic material, a partial screw thread cutting processing is conducted (refer to FIG. 8C), or both the step processing and screw thread cutting processing are conducted, so that friction becomes larger.

However, in this case, a processing margin for the step or the convex-concave of the screw thread is necessary, so that the thickness of the cylindrical shaft at the time of extrusion must be made larger (for example, for an outer diameter of 7.65 mm the hole diameter is 4 mm, refer to FIG. 9), and since cutting processing and the like of for the step and screw thread is necessary, in addition to the pointing (beveling of the tip end peripheral surface) processing and the hollowing processing performed after extrusion, there is a problem that labor and time is needed for the cutting processing and disposal of the chips, to increase the cost.

In order to solve the problems of the conventional cosmetic pencil, the present inventors have carried out earnest research of a resin that is easy to shape as well as having a good cutting characteristic, and after formation has a transparency so that the color tone of the cosmetic material inside may be distinguished. As a result, a composite material of an olefin-based polymer with color tone of the cosmetic material inside may be distinguished. As a result, a composite material of an olefin-based polymer with a polypropylene (PP) as a base material, which has been deemed unsuitable conventionally since it is hard and poor in cutting characteristic, mixed with other materials to improve a cutting characteristic, has been found to comprise these conditions.

SUMMARY OF THE INVENTION

The present invention has been made in view of the above, and an object of the present invention is therefore to provide a cosmetic pencil made of a material with which the color tone of the cosmetic material may be distinguished from the outside, which is cuttable, and to which processing to prevent the cosmetic material inside the shaft from moving may be easily carried out.

In order to achieve the above objects, the cosmetic pencil of the present invention uses the following measures.

Namely, the cosmetic pencil of the present invention is characterized in that a transparent shaft body having a good cutting property is formed from a composite material of olefin-based polymer having polypropylene as the base material, and a softened cosmetic material is filled and set in a shaft hole of the shaft body, and the tip end side of the shaft body is cut to use the cosmetic material.

Here, the composite material of the olefin-based polymer with the polypropylene as the base material, may be for example, a shaft body includes those in which even if the transparency is low, the color of the cosmetic material filled inside may be determined.

Further, the transparent shaft body may be provided with moving prevention means for the cosmetic material so that the filled cosmetic material does not move inside the shaft hole. The moving prevention means may be formed by injection molding method.

With this structure, by forming the cylindrical shaft from a transparent composite material of olefin-based polymer, the color of the cosmetic material stored can be directly seen from the outside, so that the color tone of the cosmetic material may be distinguished without the conventional marking of the cylindrical shaft or the tail cap with the same color. Further, the olefin-based polymer with the polypropylene as the base material is suitable for injection molding, and by molding the moving prevention means by the injection molding method, secondary processing such as a cutting processing is not required unlike the conventional case, work for the cutting processing and disposal of the chips is not required, thereby realizing reduction in cost.

Further, although the composite material of the olefin-based polymer is not completely transparent after formation, it has enough transparency to distinguish the color tone of the cosmetic material stored in the shaft from the outside.

The shaft body may be formed as a cylindrical shape in cross-section, or may be formed as other shapes (such as a polygon).

Illustration of the moving prevention means in the present invention

The moving prevention means of the present invention may be those in the following cases.

Namely, in the case the moving prevention means is a ring convex portion provided along the circumferential direction of the inner surface of the rear end side of the shaft hole, the filled cosmetic material hardens and sets surrounding the ring convex portion, to stop the cosmetic material in the shaft hole moving in the shaft direction. Further, in the case that the moving prevention means is a tapered surface where the inner diameter of the shaft hole at the tip end side is smaller than that at the rear end side, the tapered surface prevents the cosmetic material in the shaft hole moving to the tip end direction. The rear end of the cylindrical shaft is usually fitted with the tail cap, and by this tail cap moving of the cosmetic material to the rear end direction may be prevented, so that by providing the tapered surface, the moving of the cosmetic material in the shaft direction may be prevented.

In the case that the moving prevention means is provided by forming the inner peripheral surface inside the shaft hole into a polygon in cross-section, or in the case that a knurled vertical rib and/or vertical groove is formed in the inner surface of the shaft hole along the shaft direction, the cosmetic material filled in the corner portion of the polygon or the vertical rib and/or the vertical groove is set hard, it prevents the cosmetic material in the shaft hole from moving in the circumferential direction.

The cosmetic pencil according to the present invention is realized also when the below structure is further added to the above necessary structural elements. The added structural elements mean that the tip end side outer peripheral surface of the cylindrical shaft has a beveled shape. This shape can be obtained at the time of injection molding, in contrast to the conventional case where beveling (pointing) processing is conducted after extrusion. Therefore, the time for cutting processing and disposal of the chips is not required, thereby realizing cost reduction.

DETAILED DESCRIPTION OF THE PREFERRED EMBODIMENTS

Hereinbelow, the cosmetic pencil according to an embodiment of the present invention is described in detail with reference to the figures.

Figure 1:
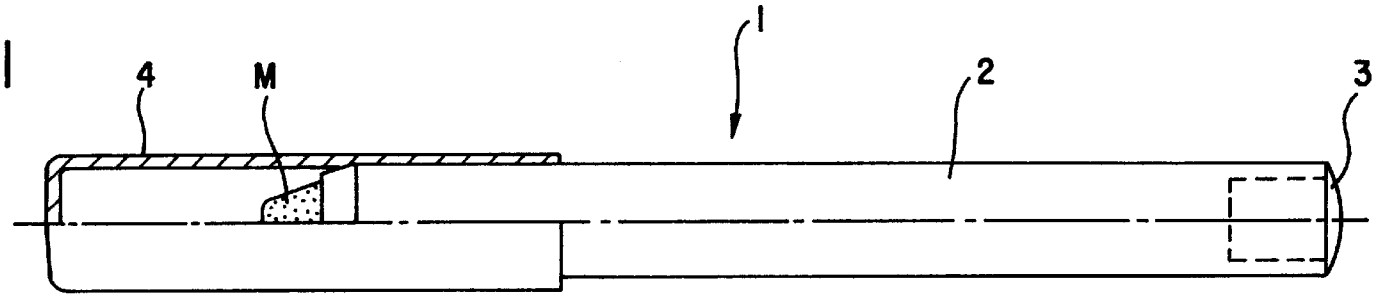
FIG. 1 is a partial sectional view of the outer appearance of a cosmetic pencil according to an embodiment of the present invention.

As shown in FIG. 1, a cosmetic pencil 1 of this embodiment is comprised of a cylindrical shaft 2 for storing a cosmetic material M, a tail cap 3 fitted to the rear end of the cylindrical shaft 2, and a cap member 4 fitted to the tip end of the cylindrical shaft 2.

Figure 3A:
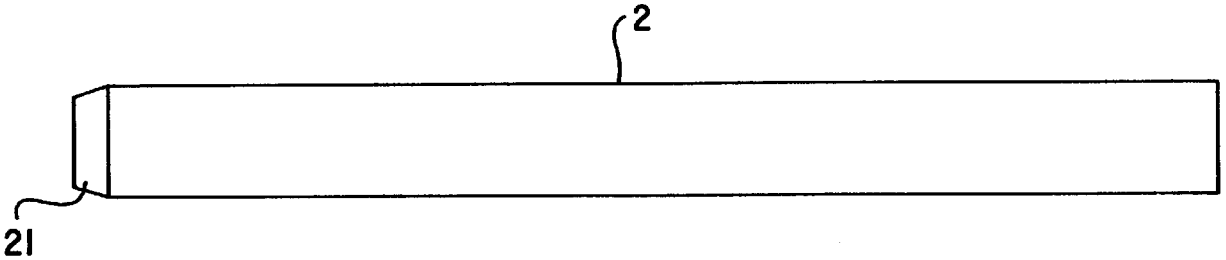
FIGS. 3A and 3B are, respectively, a view of the outer appearance, and a vertical sectional view showing the cylindrical shaft.
Figure 3B:
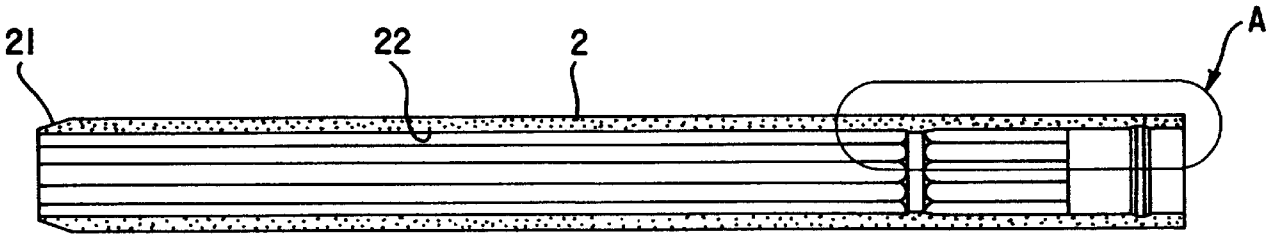

As shown in FIG. 3A, the cylindrical shaft 2 is formed with a beveled portion 21 at the tip end side outer periphery surface which reduces in diameter as it nears the tip end. Further, as shown in FIG. 3B, the cylindrical shaft 2 is formed with a shaft hole 22 in the shaft direction. Then, this shaft hole 22 is formed with a moving prevention means 5 to prevent the stored cosmetic material M form slipping and moving inside the shaft hole 22, and a hollowed portion 6 for fitting the tail cap 3.

Figure 4:
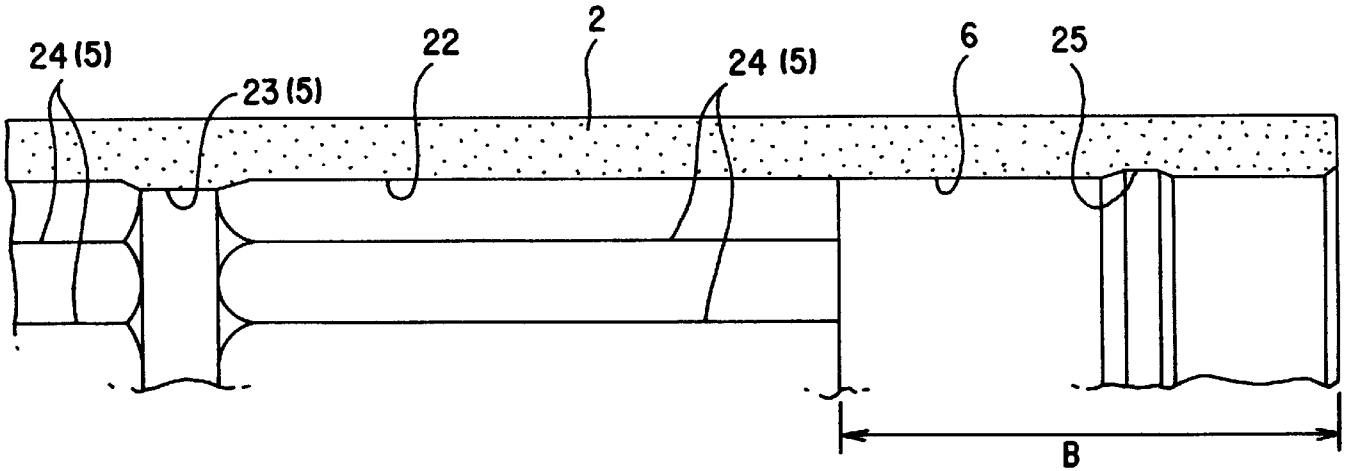
FIG. 4 is an enlarged view of a portion A of FIG. 3B.

As shown in FIG. 4, the moving prevention means 5 is structured from a ring convex portion 23 for preventing the shaft direction movement of the cosmetic material M, and an angular portion 24 on the inner peripheral surface of the shaft hole 22 for preventing the peripheral direction movement of the cosmetic material M.

Figure 5:
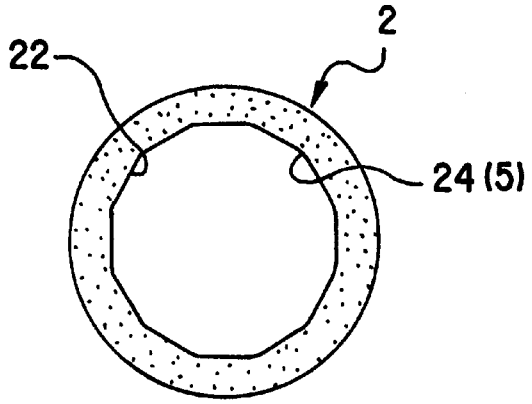
FIG. 5 is a cross-sectional view of a cylindrical casing.

As shown in FIG. 3B, the ring convex portion 23 is provided protruded along the inner peripheral surface at the rear end side of the shaft hole 22. Further, as shown in the cylindrical shaft cross-sectional view of FIG. 5, the inner peripheral surface of the shaft hole 22 is a dodecagon in the cross-sectional surface hole shape, and twelve angular portions 24 are provided along the shaft direction.

The hollowed portion 6 is a stepped hole extending from the rear end of the shaft hole 22 by a dimension B. The hole diameter of the stepped hole is slightly larger than the diagonal line of the dodecagon that passes through the axial center. The outer peripheral surface of the tail cap 3 is fitted to this stepped hole. A ring concave portion 25 is formed along the inner peripheral surface of the stepped hole.

The material of the cylindrical shaft 2 is a composite material of an olefin-based polymer closely combined with a styrene-based resin.

Namely, the olefin-based polymer is, for example, high-density polypropylene, ethylene propylene copolymer, degenerative polypropylene, and the like. Further, the styrene-based resin is, for example, polystyrene, acrylic resinonitrile-styrene copolymer, acrylic resinonitrile-butadiene-styrene copolymer, and the like.

As an example of a resin that may be added to the olefin-based polymer, acrylic resin and ethylene vinyl acetate polymer may be given.

Further, in this embodiment, a composite material with polystyrene closely combined with polypropylene is used.

The composite material of polypropylene and polystyrene (composite material of olefin-based polymer) is a material having a cutting characteristic that is easily cut by a commercially sold knife or sharpener (pencil sharpener) and the like, and a shaping characteristic in which the cylindrical shaft 2 is easily formed by injection molding. The composite material of polypropylene and polystyrene are almost transparent after molding, and is a material that has sufficient transparent characteristics to determine the color of the stored cosmetic material M in the cylindrical shaft 2 from the outside, anti-chemical characteristics so that it is not ruined by a component of the stored cosmetic material M, and a sufficient rigidity and strength, and the like.

The composite material of polypropylene and polystyrene (composite material of olefin-based polymer) is dry blended in advance, and then mulled by a melting kneader. In the case of melting and kneading, it is conducted at a temperature in which the olefin-based polymer melts or higher.

The melted composite material of the olefin-based polymer is injected to the cylindrical shaft mold by pressure, to cool and harden and to inject mold the cylindrical shaft 2. Namely, the cylindrical shaft mold is designed in advance with the shape of the beveled portion 21, the shaft hole 22, the moving prevention means 5 (the ring convex portion 23 and the angular portions 24 of the dodecagon), the hollowed portion 6, and the ring concave portion 25, and these shapes are integrally formed by the injection molding method.

Figure 2:
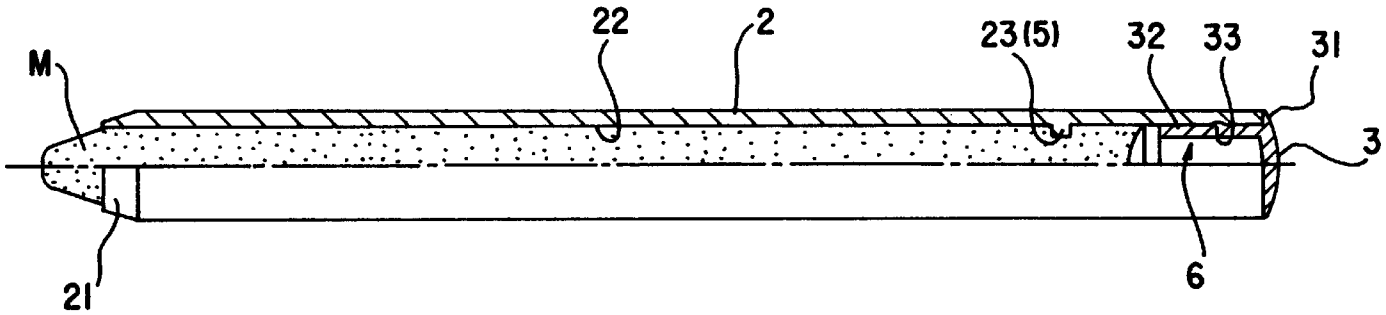
FIG. 2 is a partial sectional view of the outer appearance of a cosmetic pencil with a cap member taken off.

Next, as shown in FIG. 2, the tail cap 3 is structured from a flange portion 31 and a columnar portion 32. The outer diameter of the flange portion 31 is almost the same as the outer diameter of the cylindrical shaft 2. The outer diameter of the columnar portion 32 is almost the same as the stepped hole diameter of the hollowed portion 6, and is a dimension that is fittable to the hollowed portion 6. Further, the columnar portion 32 has a protrusion 33 that is provided protruding along the outer peripheral surface. The protrusion 33 is formed in a position that engages with the ring concave portion 25 on the hollowed portion 6 sides when the columnar portion 32 is fitted to the hollowed portion 6.

The cap member 4 is formed in a cylindrical shape with a bottom. Note that, the material of the tail cap 3 and the cap member 4 uses the transparent resin material. However, since properties such as cutting characteristics are not required, there is no need to use the same transparent olefin-based polymer composite material of cylindrical shaft 2.

The cosmetic material M refers to eye shadow, that is obtained by combining oil component (for example, animal plant oil and fat, wax, Vaseline, liquid paraffin, surfactant and the like) 60 to 80%, colorants (for example, pigment or dye of black, gray, green, blue or like other colors) 20 to 40%, and further an adequate amount of perfume and antioxidant. The filling of the cosmetic material M is carried out in a back filling method by filling the cylindrical shaft 2 from the rear end after the cosmetic material M has been heated and added with flowability.

Figure 7:
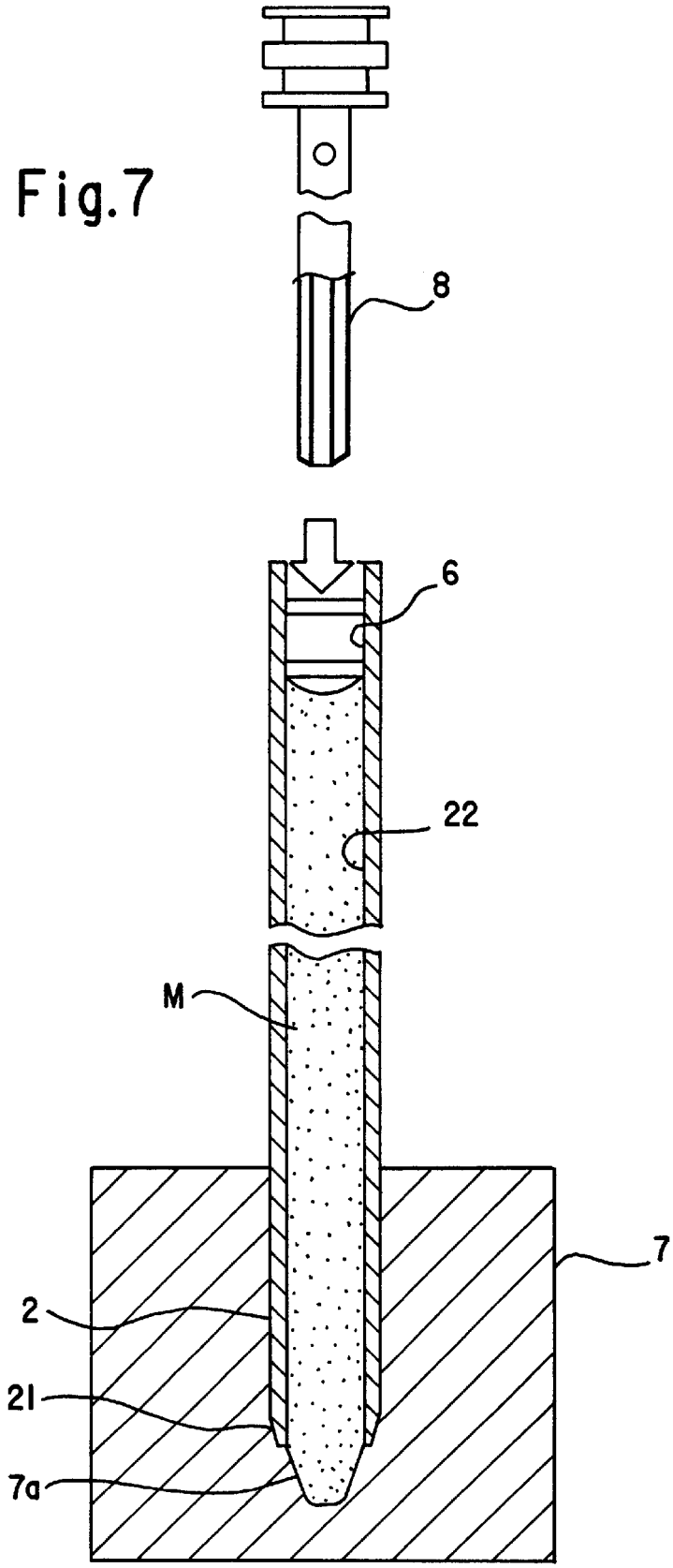
FIG. 7 is a view showing a method of a back filling method for filling a cosmetic material in the cylindrical shaft.
Figure 8A:
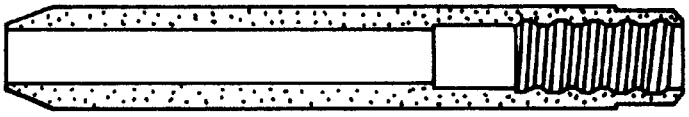
FIGS. 8A to 8C are, respectively, views showing conventional cylindrical shafts in a case where a step and a screw thread are formed, a case where only a step is formed, and a case where only the screw thread is formed.
Figure 8B:
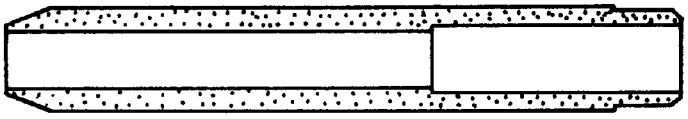
Figure 8C:
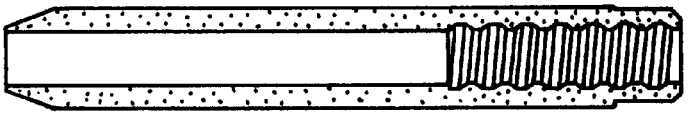
Figure 9:
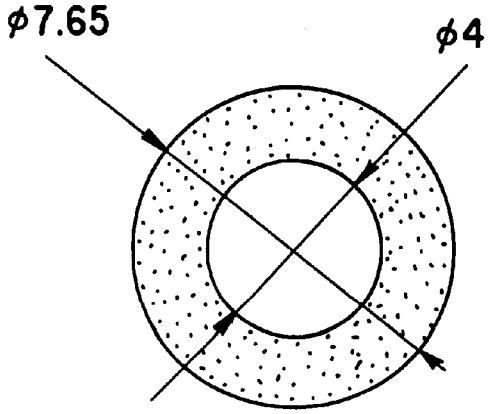
FIG. 9 is a cross-sectional view of a conventional cylindrical shaft.

Next the procedure of filling the cosmetic material M into the cylindrical shaft 2 of this embodiment is explained referring to FIG. 7.

The cosmetic pencil 1 is filled with the cosmetic material M in the back filling method. At that time, as a molding jig a mold 7 is used. The mold 7 is provided with a molding hole 7*a* for molding the tip end shape of the cosmetic material M into a rocket shape.

The tip end of the cylindrical shaft 2 is inserted into the molding hole 7*a* of the mold 7, and the cosmetic material M melted is injected from the filler nozzle 8 into the molding hole 7*a,* and the shaft hole 22 from the rear end of the cylindrical shaft 2. The injection is completed at a point where only the hollowed portion 6 of the shaft hole 22 is left.

After the cosmetic material M is cooled and hardened, when an inner dish 2 is separated from the mold 7, the tip end portion of the cosmetic material M is molded into a rocket shape.

Further, as shown in FIG. 1, when the cosmetic material M is stored in the cylindrical shaft 2, the tail cap 3 is fitted to the rear end of the cylindrical shaft 2, the tip end of the cylindrical shaft 2 is fitted to the cap member 4, to manufacture the product of a cosmetic pencil 1.

The user of the cosmetic pencil 1 takes off the cap member 4, to depress the protruded cosmetic material M from the beveled portion 21 of the cylindrical shaft 2 to the portion to be used, or to rub off with a brush or the like. Further, when the cosmetic material M protruding from the beveled portion 21 becomes little, the beveled portion 21 is sharpened by a sharpener or the like, to make the cosmetic material M protrude from a new beveled portion 21.

With the cosmetic pencil 1 of this embodiment, the color of the stored cosmetic material M may be directly seen from the outside since the cylindrical shaft 2 is formed from a transparent composite material of olefin-based polymer. Therefore the color tone of the cosmetic material M may be distinguished without marking the same color as the cosmetic material on the cylindrical shaft or the tail cap as in the conventional case.

The cosmetic material M filled and hardened in the cylindrical shaft 2 is prevented from moving in the shaft direction by the friction with the contact of the inner peripheral surface as well as the ring convex portion 23. Further the cosmetic material M in the shaft hold 22 is prevented from moving in the rotation direction by the angular portions 24 of the dodecagon in addition to the friction with the inner peripheral contact. Accordingly, in the case that the cosmetic pencil 1 drops or the cosmetic material M is depressed when in use, the moving prevention means 5 may prevent the filled cosmetic material M from moving in the shaft hole 22.

By integrally molding the moving prevention means 5, as well as the beveled portion 21, the hollowed portion 6 and the like, by the injection molding method, as conventionally there is no need to perform post-processing such as cutting processing, unlike the conventional case, the time for cutting processing, the disposal of the chips and the like is not necessary, and cost reduction may be realized. Further, by integrally molding by the injection molding method, the thickness of the cylindrical shaft becomes thinner.

For example, conventionally, the outer diameter of the cylindrical shaft is 7.65, and the inner diameter is 4.00, whereas the outer diameter thereof in this embodiment is 7.65 and the inner diameter is an average of 5.50. The thickness of the cylindrical shaft is thus thinned. The cutting characteristic is improved by making the inner diameter larger, ogive filling for filling the cosmetic material from the rear end is possible, fewer troubles occur and productivity is improved.

Further, in this embodiment, since composite material of olefin-based polymer is used for the cylindrical shaft, poisonous gas is not produced when incinerating, and protection of the environment from air pollution is considered.

Other Embodiments

The moving prevention means of the present invention may be realized in other embodiments shown below.

Namely, in the first embodiment, in the case that the moving prevention means is a tapered surface (not shown) where the inner diameter of the shaft hole of the tip end side is smaller than the diameter of the tip end side, this tapered surface acts to prevent the cosmetic material M in the shaft hole from moving to the tip end direction. Note that, the rear end of the cylindrical shaft is usually fitted a tail cap 3 and this tail cap 3 prevents the movement of the cosmetic material M to the rear end direction. diameter of the tip end side, this tapered surface acts to prevent the cosmetic material M in the shaft hole from moving to the tip end direction. Note that, the rear end of the cylindrical shaft is usually fitted a tail cap 3 and this tail cap 3 prevents the movement of the cosmetic material M to the rear end direction. Therefore by providing the tapered surface, the movement in the shaft direction of the cosmetic material may be prevented.

Figure 6A:
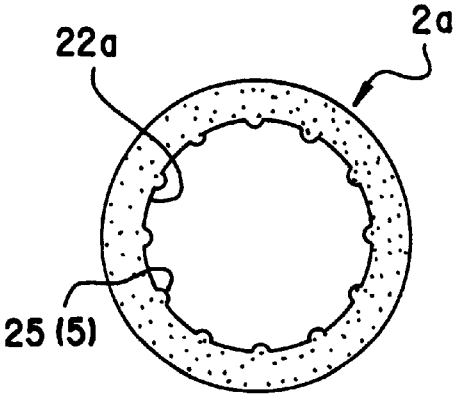
FIGS. 6A and 6B are, respectively, views showing a case where the moving prevention means is a vertical rib, and a case where the moving prevention means is a vertical groove of a cross-sectional view of the cylindrical shaft according to another embodiment of the present invention.

As shown in FIG. 6A, in a second embodiment, in the case that the moving prevention means 5 provided in a cylindrical shaft 2*a* is a knurled vertical rib 25 along the shaft direction in the inner surface of a shaft hole 22*a,* the filled cosmetic material M firmly sets surrounding the vertical ribs 25, to thereby act to prevent the cosmetic material M inside the shaft hole 22*a* from moving in the peripheral direction.

Figure 6B:
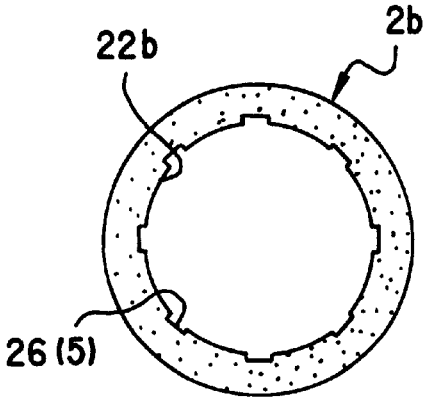

As shown in FIG. 6B, as a third embodiment, in the case that the moving prevention means 5 provided in a cylindrical shaft 2*b* is a vertical groove 26 along the shaft direction in the inner surface of the shaft hole 22*b,* the filled cosmetic material M firmly sets adjacent to the convex-concave of the inner peripheral surface including the vertical groove 26, to thereby act to prevent the cosmetic material M inside the shaft hole 22*a* moving in the peripheral direction.

In this way, by using a raw material that facilitates the molding processing, it becomes easier to provide various modes of eyebrow pencil and the like may be stored. Further, specifically, as a lip color pencil, dye (for example, eosin acid, phloxine acid and a reduction of these or the like), wax (bee wax, carnaubanax wax, candelila wax, etc.,) and oil (for example, coconut oil, high quality alcohol, liquid paraffin, and the like) may be heated and mixed uniformly, or a pigment combined therewith maybe used.

Note that, in the respective embodiments, an example of storing a cosmetic material in the cylindrical shaft is shown, but the present invention includes writing utensils filled with a pigment in the cylindrical shaft and the like.

According to the present invention, by forming a cylindrical casing from a transparent composite material of olefin-based polymer, cutting property and transparency are both obtained, the color of the stored cosmetic material can be directly seen from the outside, so that, unlike the conventional case, the same color as the cosmetic material need not be marked on the cylindrical shaft or the tail cap, and a cosmetic pencil where the color tone of the cosmetic material may be distinguished may be provided.

What is claimed is:

1. A cosmetic pencil comprising:

a transparent shaft body having a good cutting property is formed from a composite material of olefin-based polymer having polypropylene as a base material and a resin material consisting of one or more resins selected from the group of acrylic resin, ethylene vinyl acetate polymer, and styrene-based resin, the resin material being transparent and rigid;

a softened cosmetic material, the softened cosmetic material is filled and set in a shaft hole of said transparent shaft body, and a tip end side of said transparent shaft body is cut to use said cosmetic material; and wherein the transparent shaft body comprises a moving prevention means within the shaft hole so that the softened cosmetic material is prevented from moving, and is formed integrally with the transparent shaft body by an injection molding means.

2. A cosmetic pencil according to claim 1, wherein said moving prevention means is a ring convex portion provided along the circumferential direction on a inner peripheral surface at a rear end side of the shaft hole, and by this ring convex portion, the movement of said cosmetic material in a shaft direction of the shaft hole is stopped.

3. A cosmetic pencil according to claim 1, wherein said moving prevention means is a tapered surface where a inner diameter of the shaft hole at the tip end side is smaller than the inner diameter of the shaft hole at the rear end side, and by this tapered surface, the movement of said cosmetic material within the shaft hole to the tip end direction is prevented.

4. A cosmetic pencil according to claim 1, wherein said moving prevention means is molded with a sectional shape of the inner peripheral surface of the shaft hole to be a polygon, and by this polygon shaped inner peripheral surface; the movement of said cosmetic material in a circumferential direction within the shaft hole is prevented.

5. A cosmetic pencil according to claim 1, wherein said moving prevention means is a knurled vertical rib and/or a vertical groove provided along the shaft direction of the shaft hole, and by this knurled vertical rib and/or vertical groove, the movement of said cosmetic material in a circumferential direction within the shaft hole is prevented.

6. A cosmetic pencil according to claim 1, wherein said shaft body comprises a beveled shape at an outer peripheral surface at the tip end side.

* * * * *